United States Patent [19]

Pomeroy et al.

[11] 3,968,873

[45] July 13, 1976

[54] PACKAGING FOR POWER LOADS AND FASTENERS

[75] Inventors: Raymond V. Pomeroy, Portland; Lewis A. Scott, Lake Oswego, both of Oreg.

[73] Assignee: Omark Industries, Inc., Portland, Oreg.

[22] Filed: Aug. 13, 1975

[21] Appl. No.: 604,135

[52] U.S. Cl. ..... 206/223; 206/3; 206/345

[51] Int. Cl.[2] ..... B65D 79/00; B65D 73/02; F42B 39/08

[58] Field of Search ..... 206/223, 3, 345, 346, 206/347

[56] References Cited

UNITED STATES PATENTS

| | | | |
|---|---|---|---|
| 587,970 | 8/1897 | Johnson | 206/3 UX |
| 3,095,677 | 7/1963 | Dreyfus et al. | 206/345 X |
| 3,632,032 | 1/1972 | Termet | 206/3 |
| 3,779,373 | 12/1973 | Maier | 206/346 |

*Primary Examiner*—Leonard Summer
*Attorney, Agent, or Firm*—Robert L. Harrington

[57] ABSTRACT

A semi-rigid strip including means for attaching power loads and fasteners alternately along the strip. Said power loads are attached with the head of the power load against the strip and the crimped end extending outwardly thereof and said fasteners are attached with the point of the fastener against the strip and the head of the fastener extending outwardly of the strip. Said means for attaching the power loads and fasteners to the strip being releasible in a manner whereby they can be inserted into the power load receiving chamber or barrel muzzle as the case may be and then the strip is peeled away, thus avoiding the independent handling of the separated power load or fastener. A box is adapted to contain a number of the semi-rigid strips with fasteners and power loads attached thereto with the strips positioned side-by-side within the box as to be individually removed. A tether joins each semi-rigid strip to the box so that the strip can be removed and allowed to hang from the box in position to be easily grabbed by a power actuated tool user for easy loading of the tool.

5 Claims, 9 Drawing Figures

FIG. 1
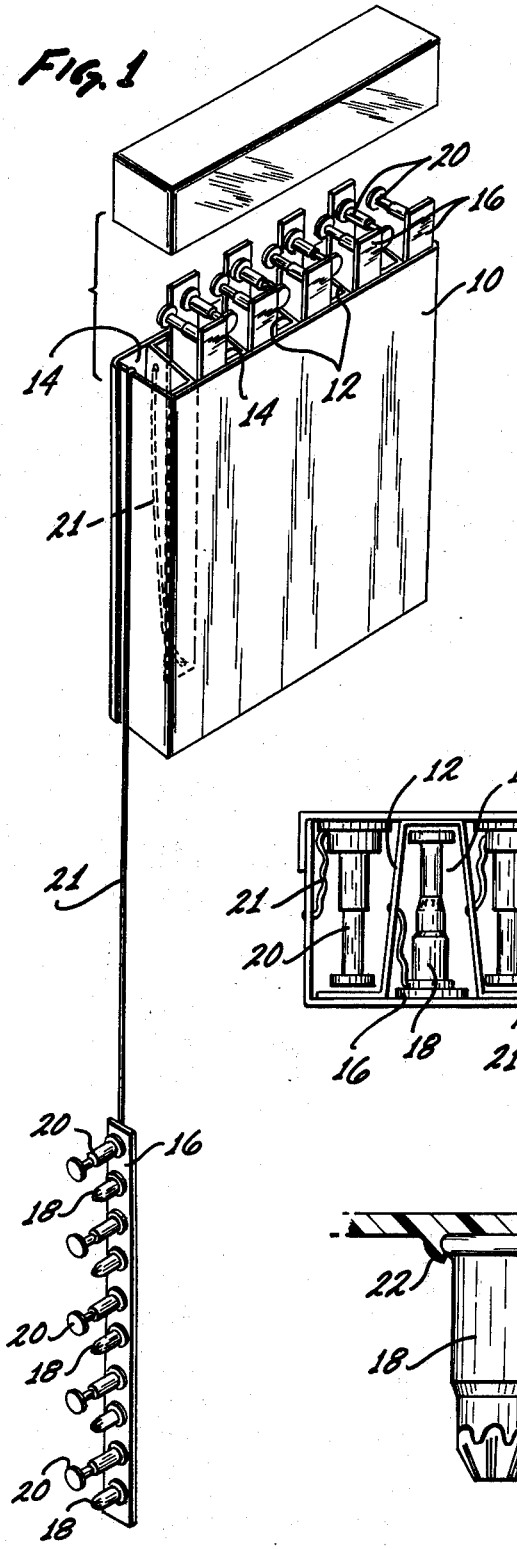
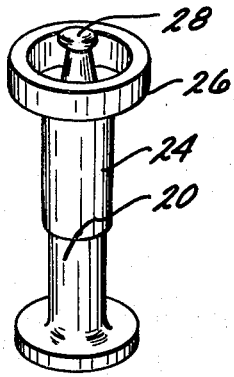
FIG. 6
FIG. 2
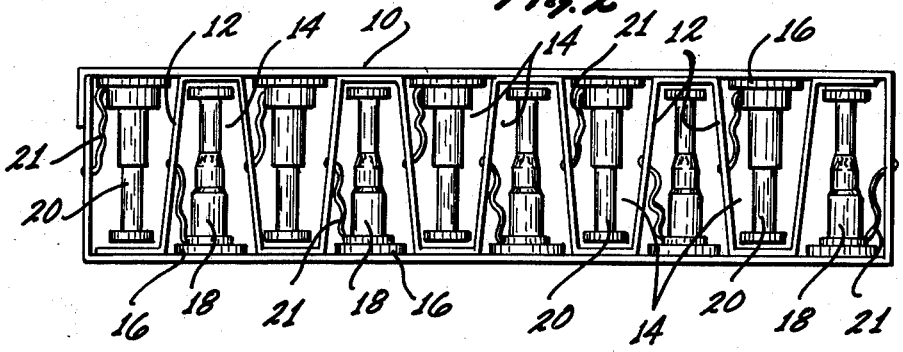
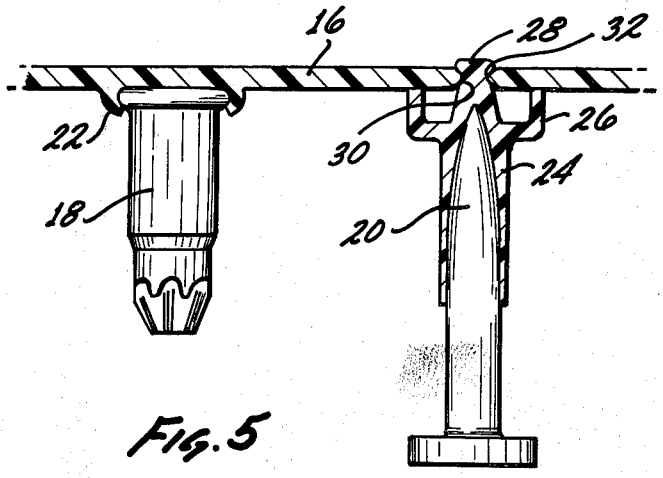
FIG. 5

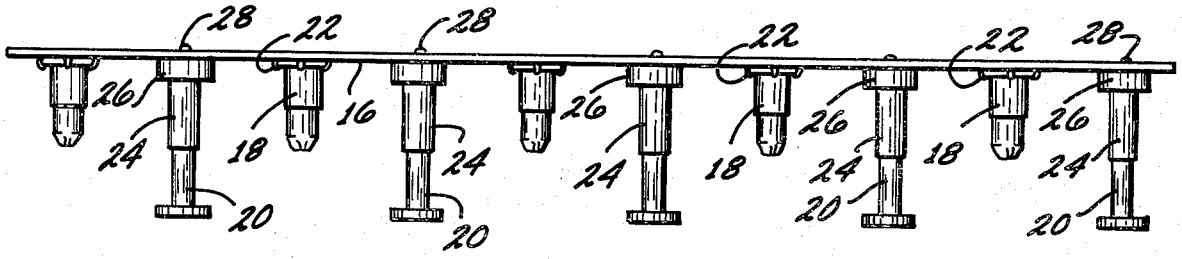
FIG. 3
FIG. 4
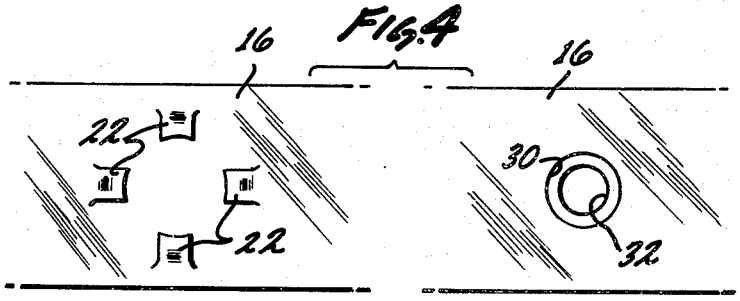
FIG. 7
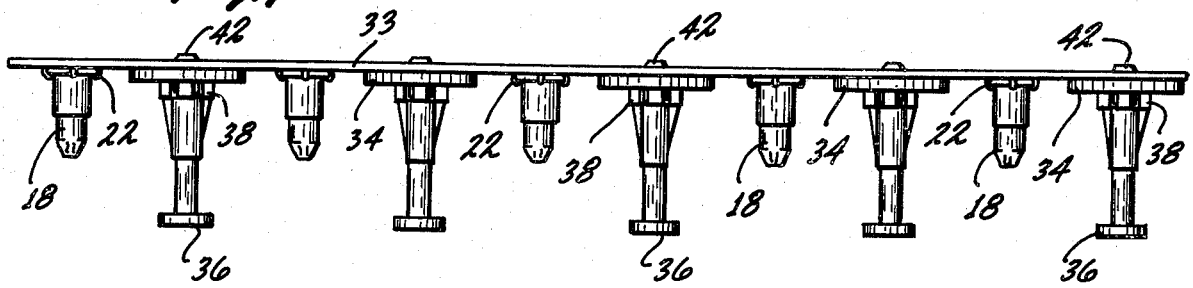
FIG. 8
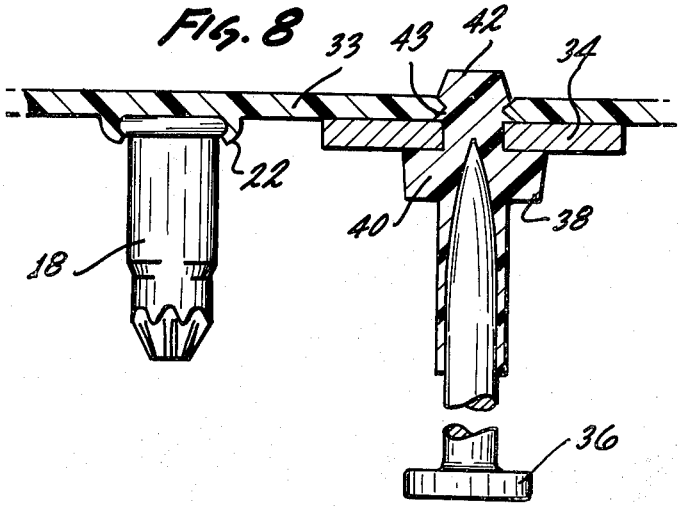
FIG. 9
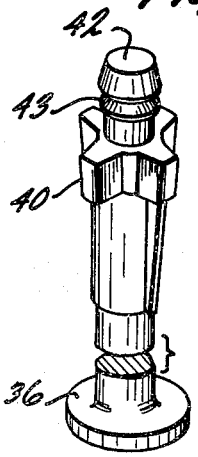

PACKAGING FOR POWER LOADS AND FASTENERS

HISTORY OF INVENTION

This invention relates to packaging for power loads and fasteners used in power actuated tools.

This invention is an improvement to the packaging invention described in the commonly assigned application for U.S. patent entitled "Packaging for Power Loads" Ser. No. 575,446, filed May 7, 1975. As described in that application, users of power actuated tools are generally workers involved in the construction of buildings. These workers find it important to be able to load the tool easily and rapidly. Whereas considerable development and expense have been directed toward improving the tools to make them more readily accessible for loading, very little attention has been paid to the means for packaging both power loads and fasteners so that they can be handled more efficiently and in that respect assist the user in the loading operation.

It is most common for construction workers using power actuated tools to wear a carpenter's apron with pockets that hold the power loads and fasteners. With conventional packaging for each loading, the worker must remove his gloves, reach into one of the apron pockets and select the desired power load, reach into another pocket and select the desired fasteners, and then proceed to insert the power load into the power load receiving chamber and the fastener into the tool muzzle. This technique, although widely used in the construction industry, is considered to be cumbersome and, indeed, much time is spent in fumbling for the power load and fastener and in some instances errors are made by loading the wrong fasteners and/or power loads. The present invention is intended to provide a packaging concept that greatly improves the workers efficiency in loading the power actuated tool.

Very briefly, in the preferred embodiment of the invention the power loads and fasteners are removeable attached to a semi-rigid strip. The fasteners and power loads are alternately positioned on the strip and oriented so that, in the case of the power loads, the head of the power load is fastened to the strip and, in the case of the fasteners, the head of the fastener is projected away from the strip. Thus without the need to previously separate the power load from the strip, it can be inserted into the power load receiving chamber and the strip thereafter merely peeled away from the protruding head of the power load. Likewise, the fastener can be inserted with the head end first into the muzzle of the tool and the strip thereafter merely peeled away from the point of the fastener. The strip is contained in a box and the box contained in the apron pocket prior to use one of the strips is removed from the box. A tether attaching the strip to the box allows the strip to hang down from the apron pocket to be easily grasped by the worker.

Having this briefly described the preferred embodiment of the invention it will be more clearly understood by reference to the following detailed description and drawings wherein:

FIG. 1 is a perspective view of a box containing a multiple of strips containing power loads and fasteners in accordance with the present invention;

FIG. 2 is the top view of the box of strips containing fasteners and power loads as shown in FIG. 1;

FIG. 3 is a side view of a strip containing the power loads and fasteners attached thereto;

FIG. 4 is a plan view of two sections of the strip showing the means for attaching the power loads and fasteners thereto;

FIG. 5 is an enlarged sectional view of the strip of FIG. 4 further illustrating the manner of fastening the power loads and fasteners thereto;

FIG. 6 is perspective view of the fastener showing the means employed on the fastener for attaching it to the semi-rigid strip;

FIG. 7 is a side view similar to FIG. 3 showing an alternate embodiment of the packaging strip;

FIG. 8 is an enlarged sectional view of the alternate embodiment of FIG. 4 similar to FIG. 5; and FIG. 9 is a perspective view of the fastener of FIG. 7.

Referring to the drawings of FIGS. 1 through 6, a box 10 is provided with a divider 12 that separates the box into a multiple of chambers 14. A strip 16 having affixed thereto power loads 18 and fasteners 20 are contained in each of the chambers 14. A tether 21 is affixed to the strip at one end thereof and the tether is fastened at its other end to the divider 12 or in the case of the strips adjacent to the side of the box the tether is affixed to the wall of the box. Referring to FIGS. 4 and 5 of the drawings, the power loads 18 are attached to the strip 16 by holding tabs 22. Thus as illustrated in FIG. 5, these holding tabs are designed to grip the head of the power load. The tabs are resilient so that by forcing the separation of the power load from the strip these tabs bend and permit release. As apparent from FIGS. 5 and 6, the fasteners 20 are provided with a cap 24 that is molded around the pointed end of the fastener. A flange portion 26 forming a part of the cap 24 is abutted against the strip and orients the fastener in its position perpendicular to the strip. An extended portion 28 of the cap 24 is in the form of a knob that is forced through an opening 30 in the strip. Because of the resiliency of the strip material it securely holds the fastener in place on the strip until removal is desired. By forcing separation of the strip from the fastener, a reduced rim portion 32 around the opening 30 flexes and permits the separation. It will be understood that the cap 24 surrounding the pointed end of the fastener 20 is made of material that shatters when impacted and thus there is no need to remove this cap before driving the fastener into the surface to be fastened. The driving of the fastener by the tool will cause the cap 24 to, in effect, disintegrate.

FIGS. 7, 8, and 9 illustrate an alternative embodiment of the invention. It will be understood that the strip 33 is designed to fit into the box similar to that shown in FIG. 1 with appropriate tethers to enable the strips to hang loose from the box as illustrated again in FIG. 1. In FIG. 7 the means for holding the power load on the strip is similar to that shown for FIG. 3 and will not be further described. The basic difference is the incorporation in the fastener assembly of a washer 34. This washer 34 is adapted (upon being driven into a working surface) to fit over the shank of the fastener and be held against the working surface by the head 36 of the fastener. As can be seen particularly in FIG. 8 the cap 38 which is molded over the pointed end of the fastener is provided with a collar 40. This collar 40 serves the washer 34 to the strip 33 in a manner whereby the washer is abutted tightly against the strip. When the fastener head and shank is inserted into the muzzle of a tool this washer becomes sandwiched between the strip 33 and the muzzle of the tool. The extended knob like portion 42 of the cap 38 is adapted to fit into an opening similar to that of opening 30 in FIG. 4 to be removed as previously described by peeling it off the point of the fastener. Projections 42 of the cap 38 receive the washer 34 to the fastener assembly when removed from the strip 33.

It will be understood that other embodiments will become apparent to those skilled in the art without departing from this invention. Thus, it is not intended that the invention be limited in scope to the embodiments illustrated, but rather the invention encompasses such other embodiments in accordance with the scope of the claims appended hereto.

What I claim is:

1. A packaging for power loads and fasteners for use in a power actuated tool comprising; a semi-rigid strip, first releasible attaching means for attaching power loads along the strip and second releasible attaching means for attaching fasteners along the strip, said first attaching means attaching to the head of the power load to enable the power load to be inserted into the receiving chamber of the power actuated tool and thereafter the strip peeled away from the power load, and said second attaching means attaching to the point of the fastener to enable the fastener to be inserted into the muzzle of the tool and thereafter the strip peeled away from the fastener.

2. A packaging for power loads and fasteners as defined in claim 1 including a box containing a multiple of the semi-rigid strips with power loads and fasteners attached thereto, and a tether connecting each semi-rigid strip to the box to allow the strip to be removed from the box and hang in a depending relationship from the box.

3. A packaging for power loads and fasteners as defined in claim 1 wherein said attaching means is comprised of finger like resilient tabs extending outwardly from the semi-rigid strip and releasibly grip the head of the power load.

4. A packaging for power loads and fasteners as defined in claim 1 wherein said second attaching means includes a cap that is contained on the fastener over the pointed end thereof with a flange portion and a knob like extension, said strip having openings defined by a resilient rim portion that is smaller than the knob like extension and accommodates the knob like extension to releasibly hold the fastener while the flange portion orients the fastener in a position perpendicular to the strip.

5. A packaging for power loads and fasteners as defined in claim 4 including a washer held by the cap in abutment with the strip, and said cap being formed of a material that essentially disintegrates upon impact.

* * * * *